US007429161B2

(12) United States Patent
Senoo et al.

(10) Patent No.: US 7,429,161 B2
(45) Date of Patent: Sep. 30, 2008

(54) AXIAL TURBINE

(75) Inventors: Shigeki Senoo, Hitachi (JP); Tetsuaki Kimura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 347 days.

(21) Appl. No.: 11/392,738

(22) Filed: Mar. 30, 2006

(65) Prior Publication Data

US 2007/0025845 A1 Feb. 1, 2007

Related U.S. Application Data

(63) Continuation-in-part of application No. 11/350,025, filed on Feb. 9, 2006.

(30) Foreign Application Priority Data

Mar. 31, 2005 (JP) ..... 2005-101371

(51) Int. Cl.
*F01D 1/02* (2006.01)

(52) U.S. Cl. ..... 415/191; 416/223 A; 416/DIG. 2

(58) Field of Classification Search ..... 415/191, 415/192, 195, 198.1, 208.1, 208.2; 416/189, 416/191, 192, 223 A, 242, 243, DIG. 2
See application file for complete search history.

(56) References Cited

U.S. PATENT DOCUMENTS 4,470,755 A * 9/1984 Bessay ..... 415/191
5,035,578 A * 7/1991 Tran ..... 416/223 A
5,292,230 A * 3/1994 Brown ..... 416/223 A
7,018,174 B2 * 3/2006 Senoo et al. ..... 415/191

FOREIGN PATENT DOCUMENTS

JP 2003-27901 1/2003

OTHER PUBLICATIONS

"Fulfilling the Need for Turbine Retrofits Which Match Demand on "Date and Duration" of Outage", by A. Hesketh, et al. Proceedings of IJPC'02, pp. 1-9.2002. pp. 1-9.
"Improvements in the Aerodynamics of Large Steam Turbines" By B R Haller, pp. 235-249. IMeche 1990. C386/017.

* cited by examiner

*Primary Examiner*—Igor Kershteyn
(74) *Attorney, Agent, or Firm*—Mattingly, Stanger, Malur & Brundidge, PC.

(57) ABSTRACT

An axial turbine includes a plurality of stages each comprising a plurality of stationary blades arranged in a row along the turbine circumferential direction and a plurality of moving blades in a row parallel to the stationary blades, each of the moving blade being disposed downstream of a respective one of the corresponding stationary blade in a flow direction of a working fluid so as to be opposed to the corresponding stationary blade. Herein, each of the stationary blades is formed so that the intersection line between the outer peripheral portion of the stationary blade constituting a stage having moving blades longer than moving blades in a preceding stage and a plane containing the central axis of the turbine, has a flow path constant diameter portion that includes at least an outlet outer peripheral portion of the stationary blade and that is parallel to the turbine central axis.

13 Claims, 14 Drawing Sheets

AXIAL TURBINE

CROSS-REFERENCE TO RELATED APPLICATION

This is a continuation-in-part of U.S. Ser. No. 11/350,025 filed on Feb. 9, 2006, the contents of which are incorporated herein by reference.

BACKGROUND OF THE INVENTION

1. Field of the Invention

The present invention relates to an axial turbine, such as a steam turbine or a gas turbine, and specifically, to an axial turbine for low pressure (i.e., a low-pressure turbine).

2. Description of the Related Art

The axial turbine increases the speed of a working fluid by allowing it to pass through stationary blades, deflects the working fluid in the rotational direction of a turbine rotor, and rotates the turbine by providing kinetic energy to moving blades by a flow having a velocity component in the rotational direction. In order to induce such a flow of the working fluid for driving the turbine rotor, the height of the outlet flow path of a turbine stage, measured in the radial direction of the turbine rotor is made higher than the height of the inlet flow path of the turbine stage, in conformance to the fact that the inlet of the turbine stage is higher in pressure than the outlet thereof. As a result, generally, in a stationary blade annular plane outer peripheral portion in each stage, the flow path height monotonously increases from the inlet toward the outlet of the stage. In other words, the radial height of the outlet of stationary blade becomes higher than the radial height of the inlet thereof (refer to JP, A 2003-27901 for example).

SUMMARY OF THE INVENTION

In a typical turbine, since the flow path height of the stationary blade annular plane outer peripheral portion monotonously increases from the inlet toward the outlet of the stage as described above, a flow having past the stationary blade has a velocity component in a radially outward direction. Usually, the flow having a velocity component in the radially outward direction increases in the relative velocity with respect to the moving blade, correspondingly. In the future, it is expected that elongation of turbine blades is performed for further improvement in performance, and hence the peripheral velocity in the moving blade outer peripheral portion would be increasingly higher. However, if the elongation of turbine blades is performed without changing the current design, that is, without elongating the axial length, then, the inclination angle of the stationary blade annular plane outer peripheral portion becomes steeper, so that a velocity component in the radially outward direction of a flow that has exited from the stationary blade increases. As a consequence, there occurs a possibility that the relative velocity of a flow entering the moving blade with respect to the moving blade will exceed the sound velocity, and turbine stage efficiency may disadvantageously decrease because of the moving blade becoming more susceptible to shock wave detriment.

The present invention is directed to an axial turbine capable of suppressing the relative velocity of a flow entering the moving blade with respect to the moving blade, and thereby improving turbine stage efficiency.

Accordingly, the present invention provides an axial turbine including a plurality of stages, wherein the stationary blade of which the radial height of its outlet is higher than that in its inlet is formed so that the intersection line between a plane containing the central axis of the turbine and the outer peripheral portion of the stationary blade, has a portion that includes at least an outlet portion of the stationary blade and that extends in the extending direction of the central axis of the turbine.

According to the present invention, it is possible to suppress the relative velocity of a flow entering the moving blade with respect to the moving blade, and thereby improve turbine stage efficiency.

DESCRIPTION OF THE PREFERRED EMBODIMENTS

Figure 1:
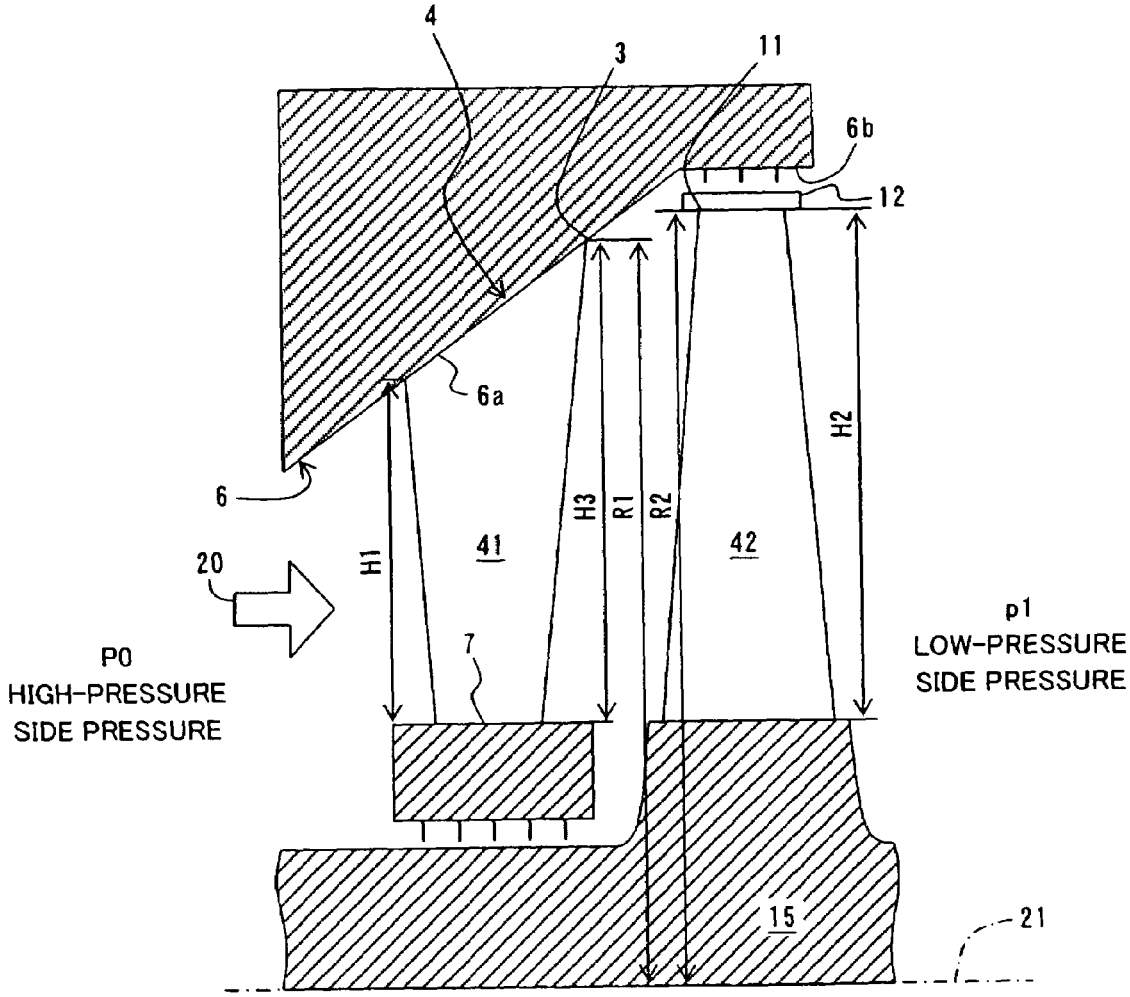
FIG. 1 is a sectional view of the basic structure of a turbine stage portion of a typical axial turbine.

FIG. 1 shows the basic structure of one turbine stage, out of a plurality of turbine stages of a typical axial turbine.

As shown in FIG. 1, each of the turbine stages of the axial turbine exists between a high pressure portion P0 located on the upstream side along a flow direction of a working fluid (hereinafter referred to merely as "upstream side") and a low pressure portion p1 on the downstream side. Each of the turbine stages comprises stationary blades (in FIG. 1, only a single stationary blade is shown for the simplification of illustration) 41 fixed between an stationary body inner wall surface 6 and inner peripheral side diaphragm outer peripheral surface 7 and moving blades (in FIG. 1, only a single moving blade is shown for the same reason as the forgoing) 42 installed on a turbine rotor 15 rotating about the central axis 21 of the turbine rotor 15. In each of the stages, there are moving blades 42 each located on the downstream side of a respective one of the corresponding stationary blades 41 in the flow direction of the working fluid (hereinafter referred to merely as "downstream side"), so as to be opposed to the corresponding stationary blade.

Here, the "stationary body inner wall surface 6" refers to the inner peripheral wall surface of a stationary body (except stationary blades) covering the turbine rotor 15, which is a rotating body. When a diaphragm (outer peripheral side diaphragm) is annularly installed on the inner peripheral side of a casing for example, the inner peripheral side wall corresponds to the "stationary body inner wall surface 6", and when there is provided no outer peripheral side diaphragm, the inner peripheral wall surface corresponds to the "stationary body inner wall surface 6". Also, for the sake of description hereinafter, out of the stationary body inner wall surface 6, a portion to which the stationary blade 41 is connected is defined as a "stationary body wall surface 6*a* on the stationary blade outer peripheral side", while a portion opposite to the outer peripheral side of the moving blade 42 is defined as a "stationary body wall surface 6*b* on the moving blade outer peripheral side".

With the above-described features, a flow 20 of the working fluid is induced by a pressure difference (P0−p1), and the flow 20 is increased in speed when passing through the stationary blade 41 and deflected in the turbine circumferential direction. The flow having been supplied with a circumferential velocity component by passing through the stationary blade 41 provides energy to the moving blade 42 and rotates the turbine rotor 15.

The stage inlet is higher in pressure and smaller in the specific volume of the working fluid than the stage outlet, so that the flow path height H1 at the stage inlet is lower than the flow path height H2 at the stage outlet. That is, in the outer peripheral portion of the stationary blade 41 and the stationary body wall surface 6*a* on the stationary blade outer peripheral side, an outer diameter line 4, which is the intersection line between a plane (meridian plane) containing the central axis 21 of the turbine and the outer peripheral portion of the stationary blade 41, inclines in radially outward direction from the moving blade outlet in a preceding stage to the moving blade inlet constituting the same stage, and the radius of the annular flow path of the working fluid linearly (or monotonously) increases in the stationary blade 41 portion. In other words, the radial height H3 of the outlet of stationary blade (i.e., stage outlet flow path height) is higher than the radial height H1 of the inlet thereof. Hence, in a stage having particularly longer blades of a typical axial turbine, the radius R1 of a stationary blade outlet outer peripheral portion 3 (the point at the stationary blade trailing edge on the outer diameter line 4, or the stationary blade outer peripheral end trailing-edge) of the stationary blade 41 is smaller than the radius R2 of a moving blade inlet outer peripheral portion (moving blade outer peripheral end leading-edge) 11 of the moving blade 42.

If the moving blade outer peripheral end peripheral velocity Mach number, obtained by dividing a rotational peripheral velocity of the inlet outer peripheral portion 11 of the moving blade 42 by the sound velocity in a fluid flowing into the outer peripheral end (outer peripheral portion within an effective length) of the moving blade 42 exceeds 1.0, then, there occurs a possibility that the relative velocity of the working fluid with respect to the moving blade 42 may becomes supersonic. If the moving blade outer peripheral end peripheral velocity Mach number exceeds 1.7, the relative velocity of the working fluid with respect to the moving blade 42 perfectly becomes supersonic.

Figure 2:
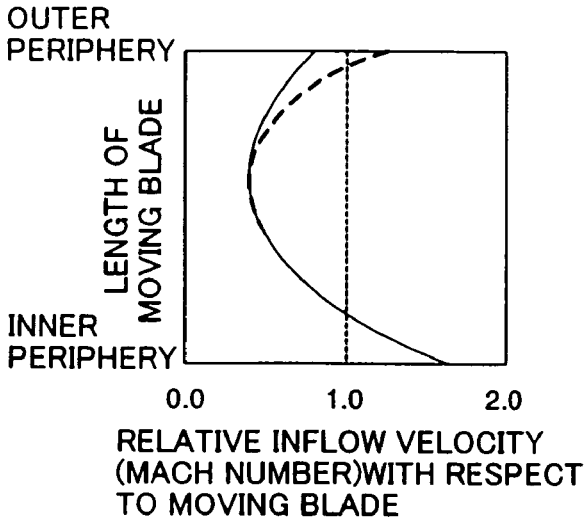
FIG. 2 is a graph showing the change along the moving blade length direction, of a relative inflow velocity of a working fluid with respect to a moving blade.

FIG. 2 is a graph showing the change along the length direction of the moving blade, of Mach number of the working fluid with respect to the moving blade (relative inflow velocity with respect to the moving blade).

The relative inflow velocity with respect to the moving blade in a stage in which the blade length is large and the moving blade outer peripheral end peripheral velocity Mach number exceeds 1.0, is prone to exceed 1.0 around the root and around the leading edge of the moving blade, as indicated by a broken line in FIG. 2. In such a case, the working fluid of which the relative velocity having become supersonic may flow into the vicinity of the root and the leading edge of the moving blade. Once the relative inflow velocity with respect to the moving blade has attained a supersonic velocity, flow is choked on the upstream side of the moving blade, so that the flow rate cannot be determined by a throat (minimum distance between moving blades adjacent to each other) of the moving blade. This makes it impossible to implement the flow of the working fluid as designed. Furthermore, detached shock wave formed upstream of the moving blade leading edge interferes with a boundary layer of the blade surface and causes large loss. Particularly on the front end side of the moving blade, since the annular plane area is large and the flow rate of the working fluid is high, the ratio of performance degradation due to the working fluid flowing in at a supersonic velocity is larger than in the vicinity of the root of the moving blade. As described above, when blade elongation is attempted in a typical turbine stage, there occurs a possibility that the relative inflow velocity of the working fluid with respect to the moving blade may attain a supersonic velocity, resulting in significantly reduced stage performance.

Figure 3:
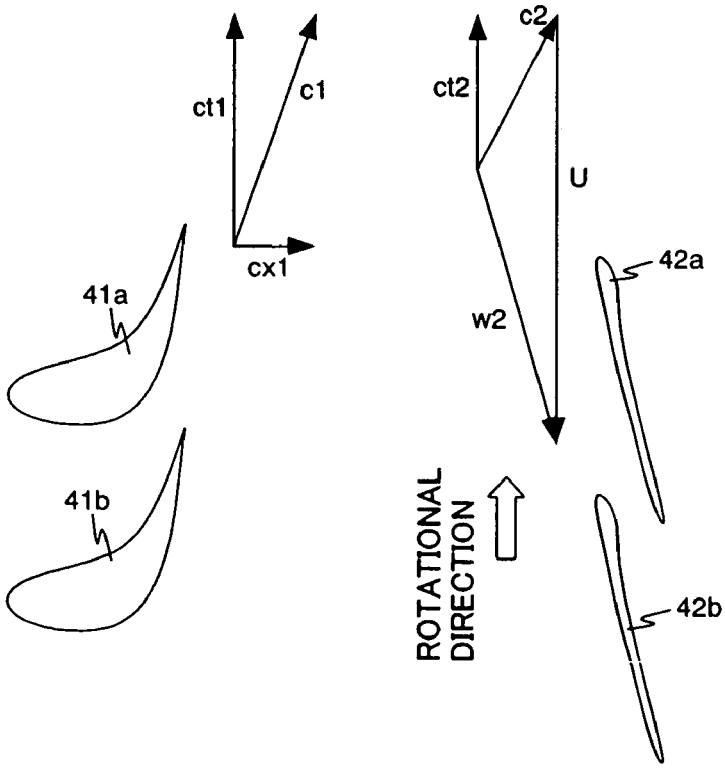
FIG. 3 is an explanatory view of a principle that a relative inflow velocity with respect to the moving blade becomes supersonic at the front end side of the moving blade in the turbine stage.

FIG. 3 is an explanatory view of the principle that the relative inflow velocity with respect to the moving blade becomes supersonic at the front end side of the moving blade in the turbine stage as shown in FIG. 1.

As shown in FIG. 3, the working fluid that has exited from a flow path formed by stationary blades 41*a* and 41*b* adjacent to each other along the circumferential direction has a flow velocity c1 at the stationary blade outlet outer peripheral portion 3 (refer to FIG. 1). The flow velocity c1 is composed of a vortical velocity ct1 as a peripheral velocity component, an axial flow velocity cx1 as an axial direction velocity component, and a radial velocity cr1 (not shown) as an outward velocity component in the turbine radial direction (i.e., a velocity component toward the front in the direction perpendicular to the plane of the figure). On the other hand, the flow that has passed through the stationary blades 41*a* and 41*b* at a flow velocity c1 flows into the outer peripheral side leading-edge 11 (refer to FIG. 1) of moving blades 42*a* and 42*b* at a flow velocity c2, the moving blades 42*a* and 42*b* being moving blade adjacent to each other along the circumferential direction and opposed to the stationary blades 41*a* and 41*b*, respectively. Here, the vortical velocity component of the flow velocity c2 is assumed to be ct2.

Here, based on the law of conservation of angular momentum between the stationary blade and moving blade, the relationship between the vortical velocity component ct1 and ct2 can be represented by the following expression, using the stationary blade outer peripheral trailing-edge radius R1 and the moving blade outer peripheral leading-edge radius R2 (refer to FIG. 1 for either of R1 and R2).

$$R1 \times ct1 = R2 \times ct2 \quad \text{(Expression 1)}$$

In the axial turbine shown in FIG. 1, $$R1 < R2 \quad \text{(Expression 2)}$$

Therefore, from Expressions (1) and (2), $$ct1 > ct2 \quad \text{(Expression 3)}$$

In this manner, the vortical velocity ct2 at the inlet of each of the moving blades 42*a* and 42*b* is smaller than the vortical velocity ct1 at the outlet of each of the stationary blades 41*a* and 41*b*.

On the other hand, on the moving blade front end side, a peripheral velocity U of the moving blades 42*a* and 42*b* is high, and hence, as shown in FIG. 3, the relative inflow velocity w2 of the working fluid with respect to the moving blades 42*a* and 42*b* has a velocity component toward a direction opposite to the rotational direction of the moving blades 42*a* and 42*b*, contrary to the flow velocity c2. Therefore, the smaller the peripheral velocity component ct2 of the flow velocity c2, the larger is the relative inflow velocity w2 with respect to the moving blade.

Considering the above-described relationship, when a flow with the vortical velocity ct1 given by the stationary blades 41*a* and 41*b* flows into the moving blades 42*a* and 42*b*, with its flow path enlarged in diameter, while having an outward velocity component in the turbine radial direction, then, as described in Expression (3), the vortical velocity ct1 reduces to ct2 (<ct1) according to the law of conservation of angular momentum, so that the relative inflow velocity w2 with respect to the moving blade increases to thereby become supersonic. That is, when attempting blade elongation, if the working fluid having passed the outer peripheral portion of the stationary blade 41 has an outward velocity component in the turbine radial direction, this would cause the relative inflow velocity w2 with respect to the moving blade to become supersonic, resulting in severely reduced turbine stage efficiency.

Based on the foregoing, an axial turbine according to an embodiment of the present invention will be described below.

Figure 4:
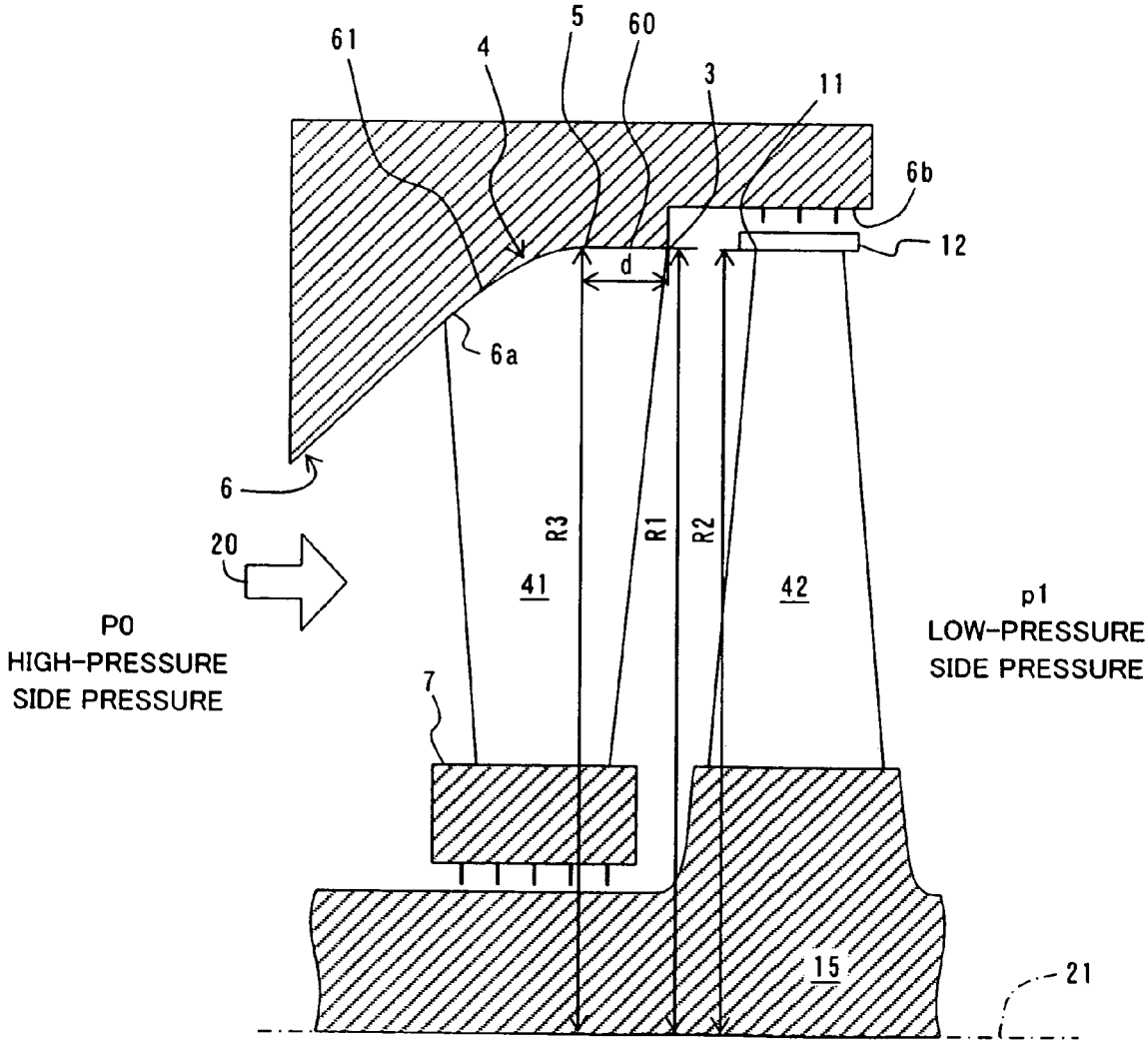
FIG. 4 is a sectional view of the main structure of an axial turbine according to an embodiment of the present invention.

FIG. 4 is a sectional view of the main structure of the axial turbine according to the embodiment of the present invention. In FIG. 4, parts that are the same as or equivalent to those in FIGS. 1 to 3 are designated by the same reference numerals, and descriptions thereof are omitted.

As shown in FIG. 4, in this embodiment, the stationary blade 41 and the stationary body wall surface 6*a* on the stationary blade outer peripheral side are formed so that the stationary blade outer diameter line 4 includes an outlet portion (outlet outer peripheral portion 3) of the stationary blade 41, and has a portion 60 that extends in the extending direction (left-and-right direction in FIG. 4) of the central axis of the turbine 21. That is, when the point located upstream by a distance d from the outlet outer peripheral portion 3 of the stationary blade along the stationary blade outer diameter line 4 is defined as a starting edge (upstream end) 5 of the extending portion 60 extending along the turbine central axis, a cylindrical annular flow path with a constant radius R3 is formed in a section from the starting edge 5 to the stationary blade outlet outer peripheral portion 3. That is, in this embodiment, in the identical turbine stage, the following relationship holds.

$$R1 = R3 \quad \text{(Expression 4)}$$

Here, the "portion extending along the extending direction of the turbine central axis 21" of the stationary blade outer diameter line 4 is substantially a portion that extends in parallel to the turbine central axis 21, and since it forms a cylindrical annular flow path with a constant radius R3 as described above, it is referred to as a "flow path constant diameter portion 60" in the description hereinafter.

Furthermore, the stationary blade 41 and the stationary body wall surface 6*a* on the stationary blade outer peripheral side are formed so that the stationary blade outer diameter line 4 has a portion 61 that inclines to the outer peripheral side in the turbine radial direction, toward the downstream side along the flow of the working fluid, and that is located on the upstream side of the flow path constant diameter portion 60. In the above-described portion 61 inclined to the outer peripheral side in the turbine radial direction, because the annular flow path formed by the stationary body wall surface 6*a* on the stationary blade outer peripheral side increases in its diameter as heads for the downstream side, this inclined "portion 61" is referred to as a "flow path enlarged diameter portion in the description hereinafter. In this embodiment, the flow path enlarged diameter portion 61 smoothly connects with the flow path constant diameter portion 60.

In addition, the height in the turbine radial direction, of the flow path equals to diameter portion 60, i.e., stationary blade outer peripheral trailing-edge radius R1, is substantially equals the height in the turbine radial direction, of the effective length outer peripheral portion of the moving blade 42 in the same stage. In this embodiment, since the moving blade 42 has a connection cover 12 for connecting it with another moving blade circumferentially adjacent thereto, the effective length outer peripheral portion of the moving blade 42 is positioned at the height of the inner peripheral surface of the connection cover 12. In this case, the height in the turbine radial direction, of the effective length outer peripheral portion of the moving blade 42 is the moving blade outer peripheral portion leading-edge radius R2. Therefore, in this embodiment, the following relationship is obtained.

$$R1 = R2 \quad \text{(Expression 5)}$$

The effective length outer peripheral portion of the moving blade 42 will be again referred to hereinafter.

Here, the turbine stage shown in FIG. 4 has a moving blade 42 longer than that in a preceding stage. The stage including the flow path constant diameter portion 60 has long moving blades 42, and specifically, this stage is a stage having long blades such that the moving blade front-end peripheral velocity Mach number, obtained by dividing a rotational velocity of the front end portion of the moving blade 42 by the sound velocity in the working fluid flowing into the front end portion of the moving blade 42 during operation, can exceed 1.0.

Figure 5:
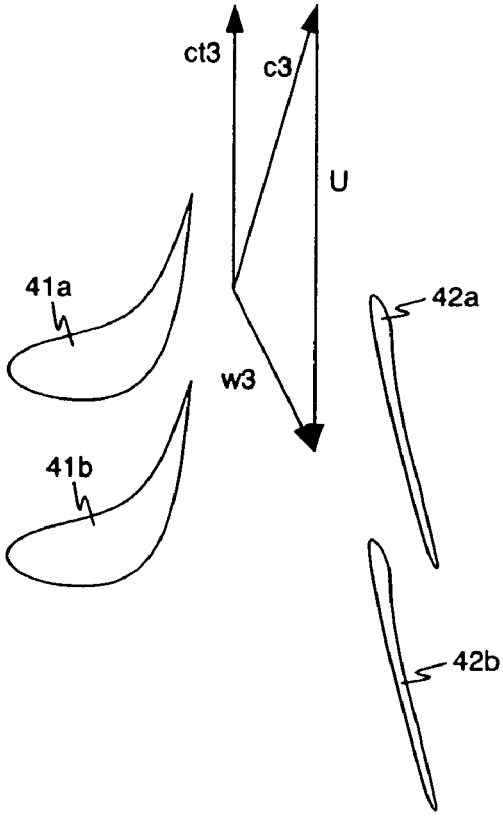
FIG. 5 is a schematic diagram showing the relative inflow velocity with respect to the moving blade in the axial turbine according to the embodiment of the present invention.

According to this embodiment, in such a turbine stage, the annular flow path of the working fluid in the vicinity of the stationary blade outlet is a cylindrical flow path that meets the condition: R3=R1. As a result, the working fluid having passed through the stationary blade 41 becomes a flow substantially parallel to the central axis of the turbine, the flow having a restrained outward velocity component in the turbine radial direction. As shown in FIG. 5, therefore, in the axial turbine according to this embodiment, vortical velocity ct3 of a flow with flow velocity c3 which flow has exited from the stationary blades 41*a* and 41*b*, flows between the moving blades 42*a* and 42*b* without virtually changing the flow velocity c3, because there occurs no deceleration of the flow due to the diametrical enlargement of its flow path. As a result, the relative inflow velocity w3 with respect to the moving blade can be reduced lower than the sound velocity, so that a flow pattern as designed can be implemented. This reduction in the relative inflow velocity w3 with respect to the moving blade to a lower value than that of the sound velocity enables a significant reduction in shock wave loss.

Also, in this embodiment, since stationary blade outer peripheral trailing-edge radius R1 is set to be approximately equal to the moving blade outer peripheral leading-edge radius R2, the working fluid having passed through the stationary blade outer peripheral portion and flowing substantially parallel to the central axis 21 of the turbine, flows into the moving blade outer peripheral portion. Hence, it is possible to allow the working fluid to flow into the effective length portion in a balanced manner, and make full use of the performance of an elongated moving blade 42 to the greatest extent possible.

Figure 6:
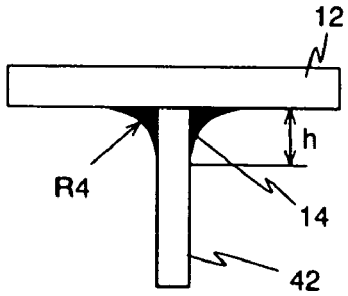
FIG. 6 is an enlarged view of the front end portion of the moving blade provided with a connection cover.

FIG. 6 is an enlarged view of the front end portion of the moving blade 42, provided with a connection cover 12.

As described above, at the front end portion of the moving blade 42, there is provided a connect cover 12 for connecting moving blades adjacent to each other along the circumferential direction. At a joint portion between the connection cover 12 and the moving blade 42, there is provided a rounded portion (buildup portion; hereinafter referred to as an R portion) 14 in order to avoid excessive stress concentration. In this case, the region from the front end side of the moving blade 42 to the R portion 14 with a height h, on the inner peripheral side in the turbine radial direction, is different in blade shape from one that has been hydrodynamically designed, and hence, it might be inappropriate to include the above-described region in the effective length portion that performs the function of converting energy of the working fluid into rotational power. Therefore, the flow path effective length outer peripheral portion of the moving blade 42 is assumed to be located between a height position of the inner peripheral surface in the turbine redial direction, of the connection cover 12, and a position located further toward the inner peripheral side in the turbine radial direction than the above-described position by the height h of the R portion 14. In short, the outer peripheral portion of the moving blade effective length can be defined to be within the range from the blade root to a position spaced apart therefrom outward in the turbine radial direction, by (R2−h) to R2.

Hence, taking even the R portion 14 in the joint portion between the moving blade 42 and the connection cover 12 into account from a hydrodynamic viewpoint, the stationary blade outer peripheral trailing-edge radius R1, for which an effective length of the moving blade 42 is used to the greatest extent possible, is not required to be precisely equalized with the moving blade outer peripheral leading-edge radius R2. The above-described Expression 5 can be permitted to take a range represented by the following expression.

$$0 \leqq (R2-R1) < h \qquad \text{(Expression 5')}$$

Also, because it is unnecessary as described above that the flow path constant diameter portion 60 is parallel to the turbine central axis 21 in a strict sense, and based on the above-described range of the effective length of the moving blade 42, the Expression (4) is can be permitted to take a range represented by the following expression.

$$-h < (R3-R1) < h \qquad \text{(Expression 4')}$$

In this case, from Expression (5'), the following relationship between R3 and R2 can be obtained $$0 \leqq (R2-R3) < 2h \qquad \text{(Expression 6)}$$

That is, when a connection cover is provided to the front end of the moving blade as in the present example, it is desirable that the inclination of the flow path constant diameter portion 60 be an inclination in a range in which the flow path constant diameter portion 60 is accommodated between a height position of the inner peripheral surface of the connection cover 12 and a position spaced apart therefrom toward the inner peripheral side along the turbine radial direction, by a height h of the R portion 14. However, when the annular flow path is inclined in the direction of enlarging the diameter toward downstream side, the starting edge 5 of the flow path constant diameter portion 60 is permitted to be located between the height position of the inner peripheral surface of the connection cover 12 and a position spaced apart therefrom toward the inner peripheral side along the turbine radial direction, by a height 2*h*.

Figure 7:
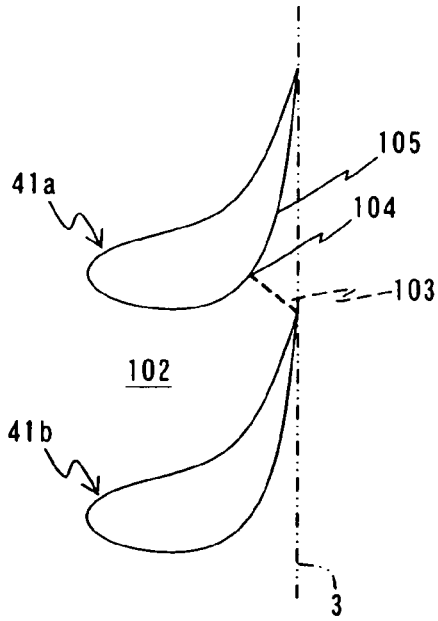
FIG. 7 is an explanatory view showing the area (length) in the axial direction in a flow path constant diameter portion.

FIG. 7 is an explanatory view showing an area (length) in the axial direction in a flow path constant diameter portion 60, wherein the state of the outer peripheral portion of each of the stationary blades 41*a* and 41*b* as viewed from the outside in the radial direction, is schematically illustrated (connection covers 12 are not shown).

As shown in FIG. 7, a throttle flow path 102 is provided between the stationary blades 41*a* and 41*b*. A throat 103 such that the distance between the stationary blades 41*a* and 41*b* is a minimum intersects a blade negative pressure plane 105 and a point 104. In this case, the working fluid is accelerated up to the throat 103 the minimum flow path width, along the throttle flow path 102 formed between the stationary blades 41*a* and 41*b*, and after having passed the throat 103, it flows into moving blade 42 substantially by an inertia motion.

That is, the working fluid in the course of passing through the throat portion is constrained and guided by the stationary blade, but its flow after having passed through this throat portion becomes free. This embodiment is arranged to introduce the flow having passed through this throat portion into the moving blade effective length by suppressing a velocity component in the radial direction by the flow path constant diameter portion 60. Herein, it is important to cause the flow exiting from the stationary blade 41 to flow into the moving blade 42 without significantly changing the position of the flow in the radial direction. With this considered, it is desirable that the flow path constant diameter portion 60 include the throat portion 103 in which the working fluid is most accelerated.

Figure 8:
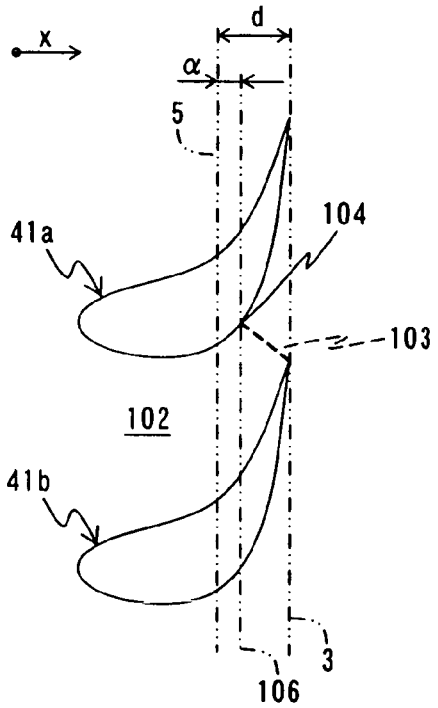
FIG. 8 is an explanatory view showing the area (length) in the axial direction in a flow path constant diameter portion.

More specifically, because it is a throat point 104 on the stationary blade negative pressure plane side that is located at the most upstream side out of the throat 103, it is desirable that the starting edge 5 (refer to FIG. 4) of the flow path constant diameter portion 60 extend from the position in the axial direction, of the throat point 104 on the negative pressure side in the stationary blade outer peripheral portion, or from further upstream side than that position to the outlet outer peripheral portion 3. With this being specifically illustrated, as shown in FIG. 8, it is desirable that starting edge 5 of the flow path constant diameter portion 60 be located on a plane 106 that contains the point 104 and that is perpendicular to the turbine central axis 21, or located upstream thereof. For example, in FIG. 8, when the direction of a flow to the downstream side is represented by the positive X-axis direction, and the x-axis direction distance from the starting edge 5 to the plane 106 is denoted by $\alpha$, a flow path constant diameter portion 60 is secured so that $\alpha \geqq 0$ is satisfied. Thereby, because the working fluid reaches the flow path constant diameter portion 60 and is given a maximum accelerating force by throttle flow path 102 in a state in which the outer peripheral side of the flow is constrained, a velocity component in a radially outward direction, of the working fluid after having exited the stationary blade 41 is more effectively suppressed.

Also, as described above, in the turbine stage into which the present invention is incorporated, the radial velocity component of an outlet flow is inhibited. In the axial turbine having a plurality of stages, according to the present invention, when the features described with reference to FIGS. 4 to 8 is applied to the final stage, the further downstream side of the final stage does not present no problem even if the radial velocity component of the working fluid that has passed is small, since the further downstream side of the final stage is provided with only an exhaust diffuser (not shown).

However, in the axial turbine having a plurality of stages, in order to expand a working fluid to increase the specific volume thereof, there are cases where the blade length is made larger as a stage is located more downstream. As a result, in the stage followed by stages located downstream thereof (i.e., stages except the final stage), the working fluid having, at the stage outlet, a velocity component in the radially outer peripheral direction smoothly flows into stages on the downstream side. In this sense, the feature of the present invention lies in that the application of the present invention to the turbine final stage alone produces a maximum effect. However, if the trend toward further longer blade proceeds, when the present invention is applied to stages in the vicinity of the final stage, including the final stage, an effect can be expected, as well. However, when the present invention is applied to turbines which are low in the number of revolutions (1500 rpm or 1800° rpm) and in which the relative velocity of the working fluid with respect to the front end of moving blade is lower than a sound velocity as in steam turbines used for current nuclear power plants and the like, it is difficult to obtain a desired effect. However, there is a possibility that steam turbines currently used for current nuclear power plants and the like will have, in the future, the same level of revolution number (3000 rpm or 3600 rpm) as that of steam turbines in thermal power plants. In that case, the present invention is applicable, thereby allowing a desired effect to be achieved.

Figure 9:
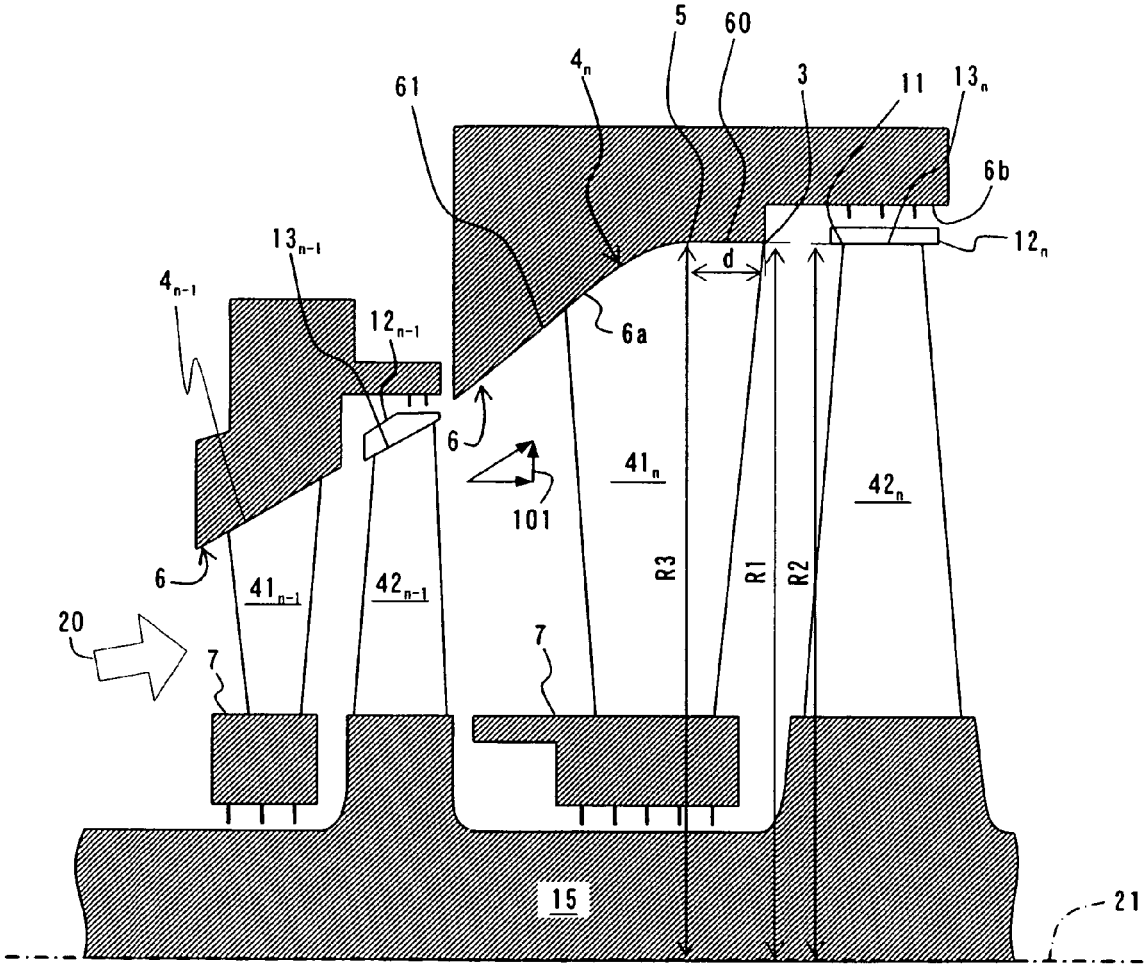
FIG. 9 is a sectional view showing the construction of the main section of a construction example of the axial turbine according to the present invention, wherein the present invention is applied to the final turbine stage alone.

FIG. 9 is a sectional view showing the construction of the main section of a construction example of the axial turbine according to the present invention, wherein the present invention is applied to the final turbine stage alone.

As shown in FIG. 9, in this example, in the axial turbine having n turbine stages, only the final stage stationary blade $\mathbf{41}_n$ constituting the turbine final stage (n-th stage) has the flow path constant diameter portion 60 in the outer peripheral portion. While the same goes for the above-described example shown in FIG. 4, when a connection cover $\mathbf{12}_n$ is provided on the front end of the moving blade like this example, the inner peripheral surface of the of the final stage moving blade $\mathbf{42}_n$ has a cylindrical shape as in the case of the flow path constant diameter portion 60 of the final stage stationary blade $\mathbf{41}_n$. That is, an outer diameter line $\mathbf{13}_n$, which is the intersection line with respect to a plane containing the turbine central axis 21, extends in the extending direction of the turbine central axis 21, the effective length of the final stage moving blade $\mathbf{42}_n$ being substantially constant.

The stationary blade upstream of the final stage is formed so that the outer diameter line (here, the outer diameter line $\mathbf{4}_{n-1}$ of the stationary blade $\mathbf{41}_{n-1}$ in the (n−1)th stage is solely illustrated), inclines in radially outward direction toward the downstream side. That is, in this construction example, stages except the final stage are each formed into a cylindrical shape in which the stationary body inner wall surface expands 6 toward the downstream side. Also, the inner peripheral surface of the connection cover of the moving blade in each of the stages except the final stage (here, the connection cover $\mathbf{12}_{n-1}$ of the moving blade $\mathbf{42}_{n-1}$ in the (n−1)th stage is solely illustrated), is also formed into a cylindrical shape in which the stationary body inner wall surface expands toward the downstream side, as in the case of the flow path constant diameter portion in the same stage. That is, an outer diameter line, which is the intersection line with respect to a plane containing the turbine central axis 21 (here, the outer diameter line $\mathbf{13}_{n-1}$ of the connection cover $\mathbf{12}_{n-1}$ is solely illustrated), inclines in radially outward direction toward the downstream side.

The extension line of the outer diameter line of the stationary blade connects smoothly in some extent with the outer diameter line of the moving blade in the same stage; the extension line of the outer diameter line of that moving blade connects with the outer diameter line of a subsequent stage; and ultimately, the extension line $\mathbf{13}_{n-1}$ of the moving blade $\mathbf{42}_{n-1}$ connects with an outer diameter line (flow path enlarged portion 61) of the final stage stationary blade $\mathbf{41}_n$, in a smooth manner to some extent. On the upstream side of the starting edge of the flow path constant diameter portion 60 in the final stage stationary blade 41*n*, the annular flow path of the working fluid is enlarged in diameter. By such an arrangement, the flow of the working fluid has a velocity component 102 in the radially outward direction up to the flow path constant diameter portion 60, and smoothly flows without causing a separated flow when flowing into the inlet of each stage, as well as, ultimately, its relative velocity with respect to the final stage moving blade $\mathbf{42}_n$ having a larger length is suppressed by the flow path constant diameter portion 60, thereby allowing turbine stage efficiency to be dramatically improved. That is, this arrangement is such one that, in each of the stages located upstream of the final stage and hence having a low possibility that a relative velocity of the working fluid with respect to the front end portion of the moving blade reaches a sound velocity, places prime importance on the smoothness of introduction of the working fluid with respect to a next blade row.

Here, the description has been made by taking the case where the present invention is applied to an axial turbine with a connection cover provided at the front end of the moving blade as an example, but the present invention is also applicable to an axial turbine in which the front end of the moving blade is not constrained by the connection cover. In this case also, a similar effect can be obtained.

Figure 10:
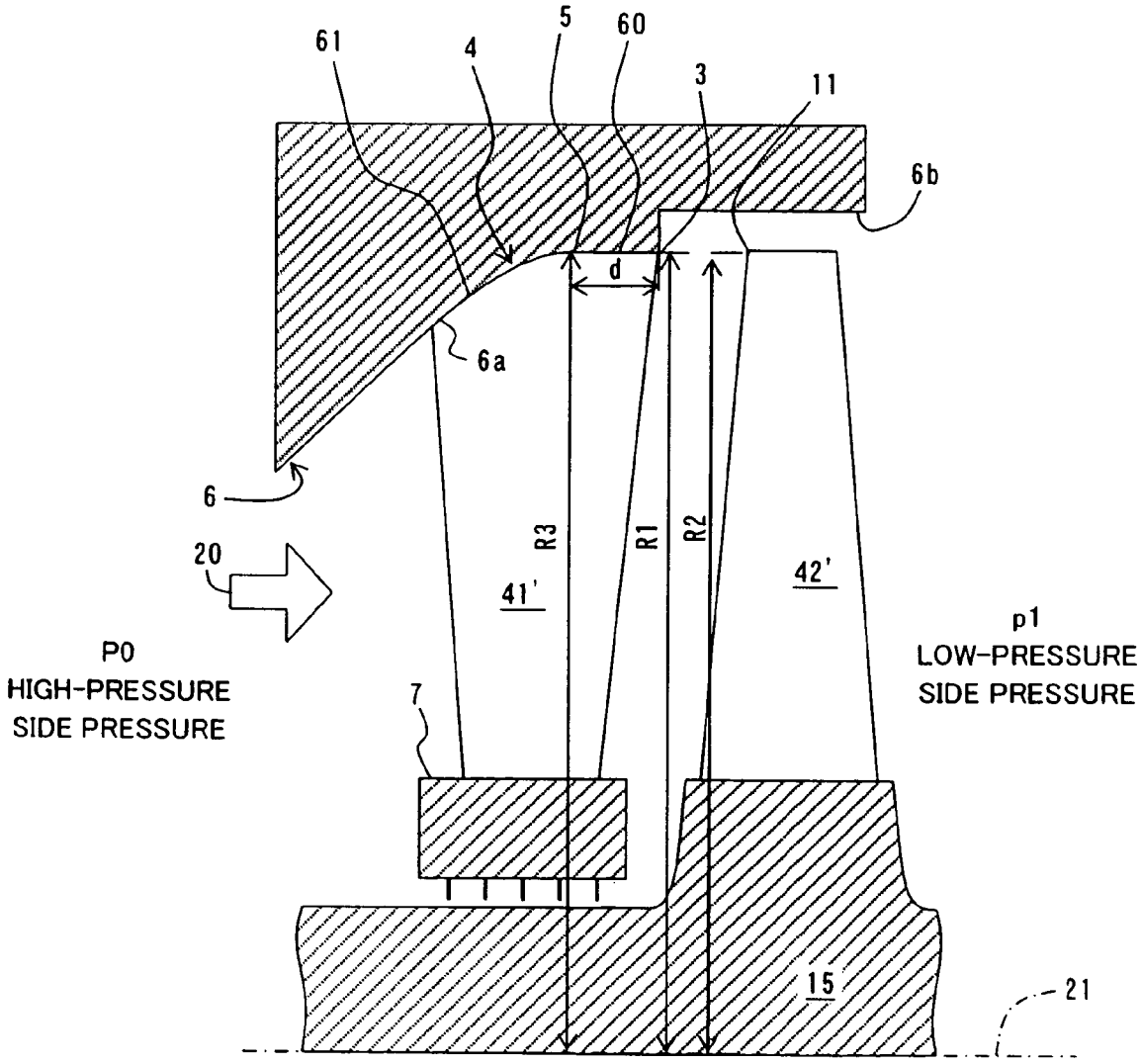
FIG. 10 is a sectional view showing the main construction of a construction example of the axial turbine according to the present invention, the axial turbine having a moving blade of which the front end is not connected to an adjacent blade by a connection cover.

Supposing that the front end of the moving blade 42 is a free end, with the moving blade 42 provided with no connection cover 12, if effective length outer peripheral portion of the moving blade 42 is the front end portion (outer peripheral portion) of the moving blade 42, the stationary blade outer peripheral trailing-edge radius R1, for which the moving blade effective length is used to the greatest extent possible, becomes equal to the moving blade outer peripheral leading-edge radius R2, so that, by satisfying the Expressions (4) and (5), it is possible to reduce the relative inflow velocity with respect to the moving blade to a lower value than the sound velocity, and use the effective length of the moving blade 42 to the greatest extent possible. However, in the relationships determined by the Expressions (4) and (5), errors within manufacturing error (e.g., on the level of 1 to 2 mm, depending on the blade length) is tolerable. FIG. 10 is a sectional view showing the main structure of a construction example of an axial turbine according to the present invention, the axial turbine having a moving blade 42' with a front end being not connected to an adjacent blade by the connection cover.

Here, the shape of the stationary body inner wall surface 6 will be further discussed.

Figure 11:
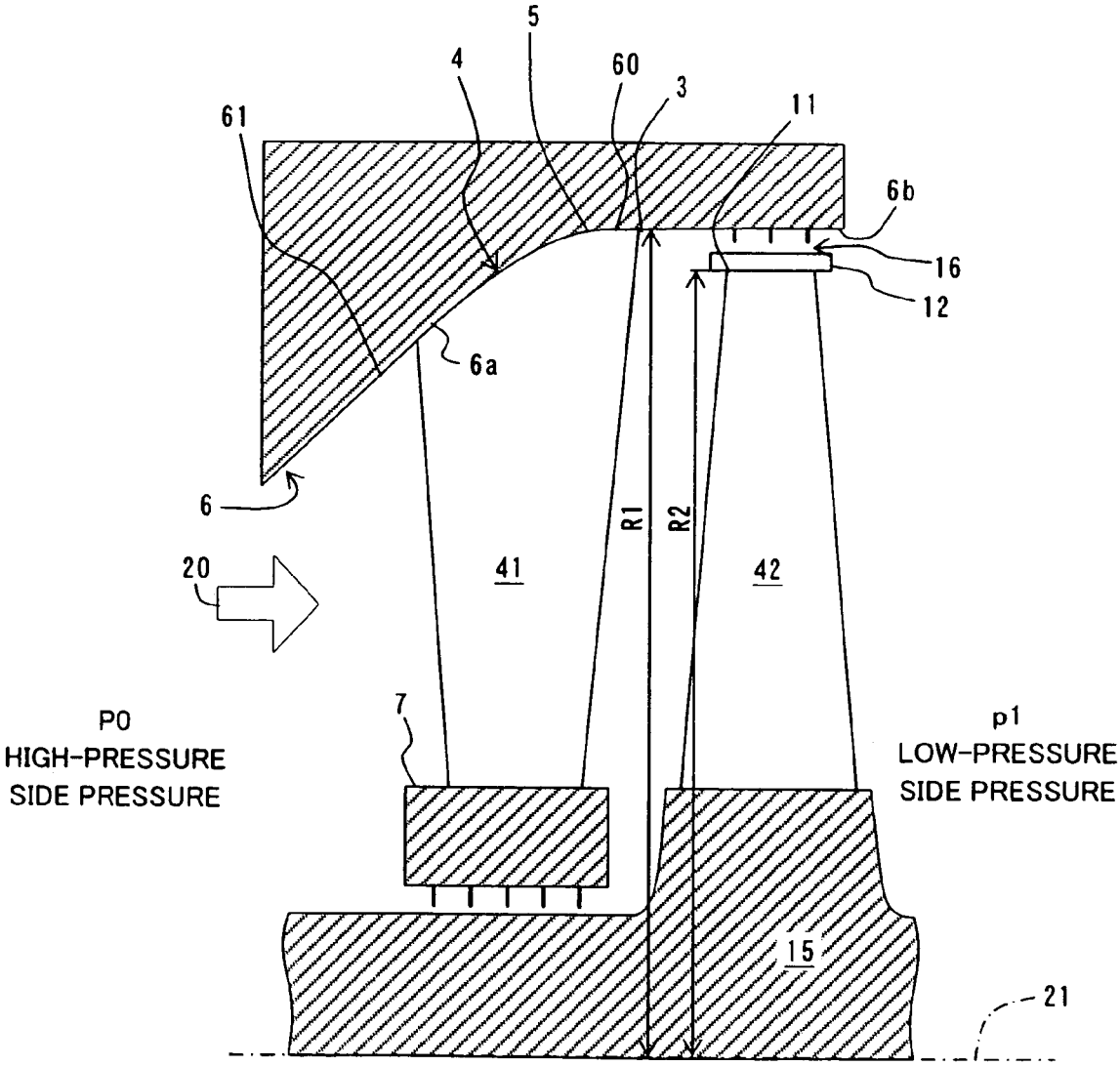
FIG. 11 is a sectional view of a comparative example of the axial turbine according to the present invention.

For example, as shown in FIG. 11, when the stationary blade outer peripheral trailing-edge radius R1 is larger than the moving blade outer peripheral leading-edge radius R2, the relative inflow velocity w3 with respect to the moving blade at the moving blade inlet 11 can be reduced to a subsonic velocity, but a flow that has passed through the outer peripheral portion of the stationary blade 41 flows toward a seal spacing 16 formed between the front end portion (to be exact, the outer peripheral portion of the connection cover 12) of the moving blade 42 and the moving blade side stationary body wall surface 6*b*. Herein, the flow that has passed through the outer peripheral portion of the stationary blade 41 unfavorably passes through the seal spacing 16, and the flow cannot be effectively used for rotating the turbine rotor 15. Hence, in order to use the effective length of the moving blade 42 to the greatest extent possible, it is desirable to satisfy the expression (5') or (6) when a connection cover is provided on the front end of the moving blade, while it is desirable to satisfy the expression (5) when no connection cover is provided on the front end of the moving blade.

In this case, in terms of structure, it is necessary for the outer peripheral side of the moving blade effective length outer peripheral portion to secure a required spacing between the moving blade side stationary body wall surface 6*b* and the moving blade effective length outer peripheral portion, and therefore, when the radial position of the flow path constant diameter portion 60 in the stationary blade outer peripheral portion is set to be on the same level as that of the effective length outer peripheral portion of the moving blade in the same stage, the moving blade side stationary body wall surface 6*b* in the stage having the flow path constant diameter portion 60 is necessarily located radially outside of the flow path constant diameter portion 60. In other words, by providing the stationary body inner wall surface 6 with a level difference between the stationary blade side and the moving blade, it is possible to efficiently introduce the working fluid rectified on the stationary blade side stationary body wall surface 6*a* into the moving blade effective length portion.

The above-described axial turbine according to this embodiment can suppress more effectively the relative inflow velocity with respect to the moving blade by variously changing design. Hereinafter, modifications in which such effective arrangements are combined will be successively described.

Figure 12:
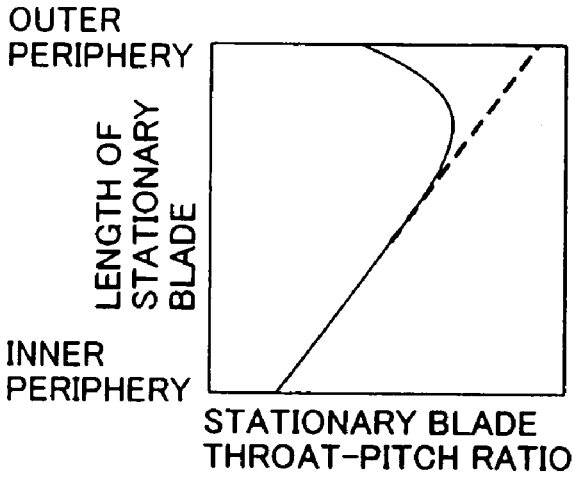
FIG. 12 is a graph showing the change of shape along the direction of blade length, of a stationary blade of an axial turbine according to a modification of the present invention, the change of shape being represented by the ratio of a throat to a pitch.

FIG. 12 is a graph showing the change in shape of the stationary blade 41 along its length direction, wherein the change of shape is represented by a throat-pitch ratio.

With respect to the axial turbine according to the embodiment shown in FIG. 4, the relative inflow velocity with respect to the moving blade can be further reduced by forming the stationary blade 41, as indicated by a solid line in FIG. 12, by giving torsion to the stationary blade 41 so that the ratio of the stationary blade throat "s" to the pitch "t", i.e., s/t becomes smaller on the outer peripheral side of the stationary blade than on the intermediate portion in the length direction thereof.

Figure 13:
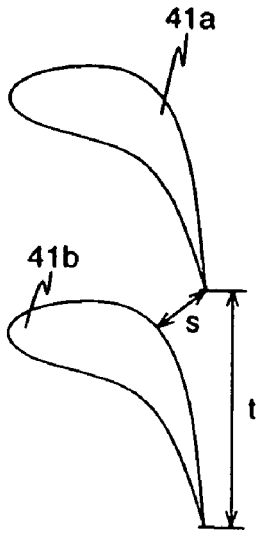
FIG. 13 is a sectional view of stationary blades of the axial turbine according to the modification of the present invention.

Here, the stationary blade throat "s" refers to a flow path portion that has the minimum area in a flow path formed between the stationary blades 41*a* and 41*b* adjacent to each other along the circumferential direction as shown in FIG. 13, that is, the minimum spacing portion between the stationary blades 41*a* and 41*b*. On the other hand, the pitch "t" refers to a distance between the stationary blades 41*a* and 41*b* in the circumferential direction.

Figure 14:
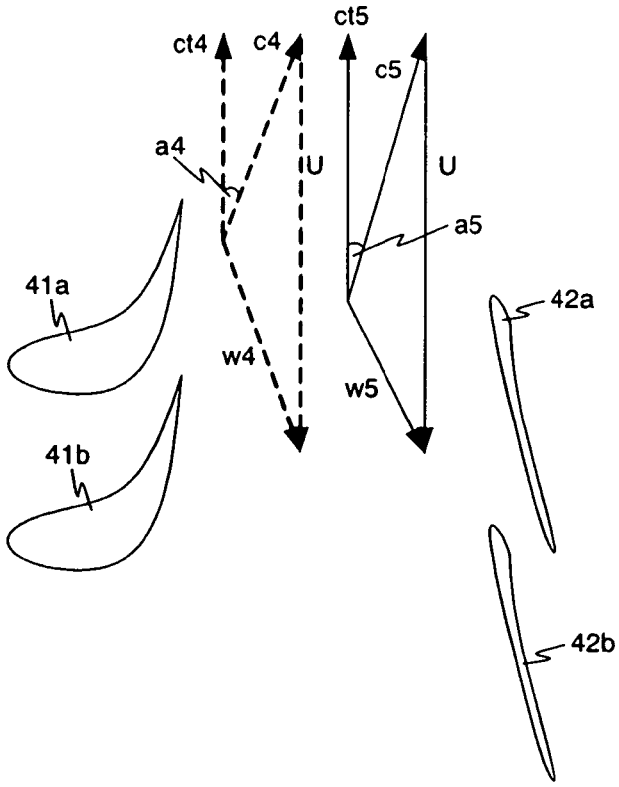
FIG. 14 is a schematic view showing the relative inflow velocity with respect to the moving blade in the axial turbine according to the modification of the present invention.

In general, the throat-pitch ratio s/t is designed so as to be small on the blade inner peripheral side and large on the blade outer peripheral side, as indicated by a broken line in FIG. 12. When the moving blade front-end peripheral velocity Mach number exceeds 1.0, by forming the stationary blade 41 so as to make small the throat-pitch ratio s/t on the outer peripheral side, as indicated by a solid line in FIG. 12, in addition to the fulfillment of the condition of the expression (4), a stationary blade discharge angle of the working fluid becomes as small as a5 (<a4), as shown in FIG. 14. Here, a4 is a stationary blade discharge angle of the working fluid when using the stationary blade shape indicated by a broken line in FIG. 12. By a reduced amount of the stationary blade throat "s", the vortical velocity ct of flows with a flow velocity c5 which flows has exited from the stationary blades 41*a* and 41*b* becomes higher than a vortical velocity ct4 of the working fluid when using the stationary blade shape indicated by the broken line in FIG. 13. Thereby, the relative velocity w4 with respect to the moving blade in this modification can be made lower than the relative velocity w5 of the working fluid with respect to the moving blade when using the stationary blade shape indicated by the broken line in FIG. 12. That is, this modification can make low the relative velocity with respect to the moving blade as compared with that of the axial turbine in FIG. 4.

Figure 15:
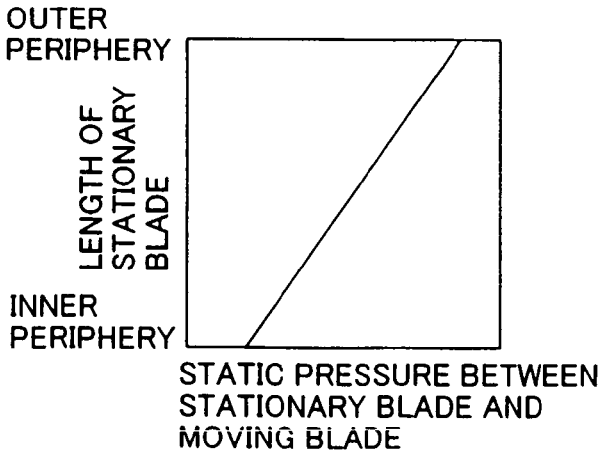
FIG. 15 is a graph showing the change along the blade length direction, of the stationary pressure between the moving blade and stationary blade.

FIG. 15 is a graph showing the change along the blade length direction, of the static pressure between the stationary blade and the moving blade in the turbine stage.

Figure 16:
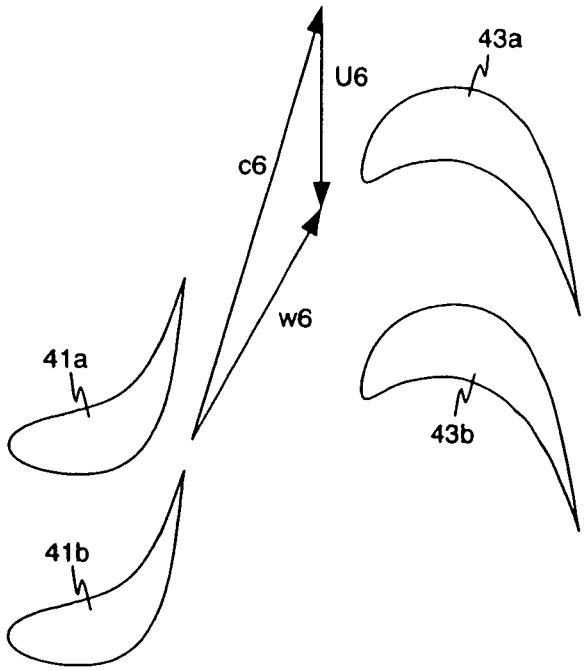
FIG. 16 is a schematic view showing the relative inflow velocity with respect to the moving blade in the inner peripheral side of the moving blade.

As shown in FIG. 15, the static pressure between the stationary blade and moving blade in the turbine stage is higher on the outer peripheral side and lower on the inner peripheral side, due to a vortical flow caused by it passing through the stationary blade. As a consequence, on the inner peripheral side where the peripheral velocity of the moving blade is low, the stationary blade outflow velocity c6 becomes higher than a moving blade peripheral velocity U6 contrary to the outer peripheral side, as shown in FIG. 16, so that the relative velocity w6 with respect to the moving blade becomes supersonic.

Figure 17:
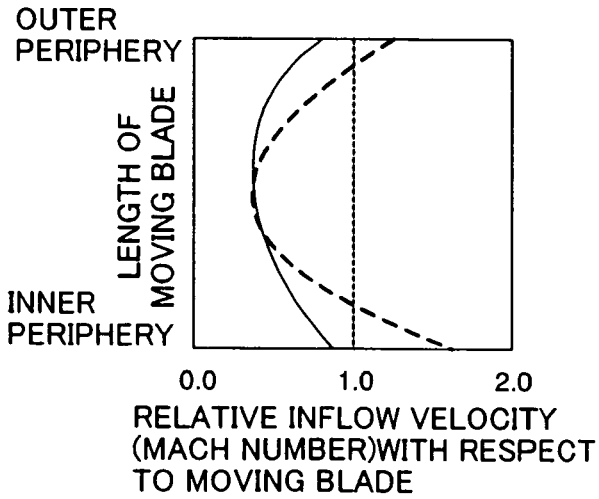
FIG. 17 is a graph showing the change along the length direction of moving blade, of relative inflow velocity with respect to the moving blade of the working fluid.

FIG. 17 is a graph showing the change along the blade length direction, of the inflow relative velocity (Mach number) of the working fluid with respect to the moving blade. In FIG. 17, the broken line indicates the change along the blade length direction, of the moving blade inflow relative velocity (Mach number) with respect to moving blade, when blade elongation is performed in a typical axial turbine. As can be seen from this graph, when blade elongation is performed in a typical axial turbine, the inflow relative velocity with respect to the moving blade might exceed the sound velocity not only on the outer peripheral side but also on the inner peripheral side of the moving blade, by the factors described in FIGS. 15 and 16. A countermeasure to prevent the supersonic inflow of the working fluid into the moving blade outer peripheral side, is to reduce the outward velocity component in the turbine radial direction, of the flow that has passed through the stationary blade outer peripheral side, as described above.

Figure 18:
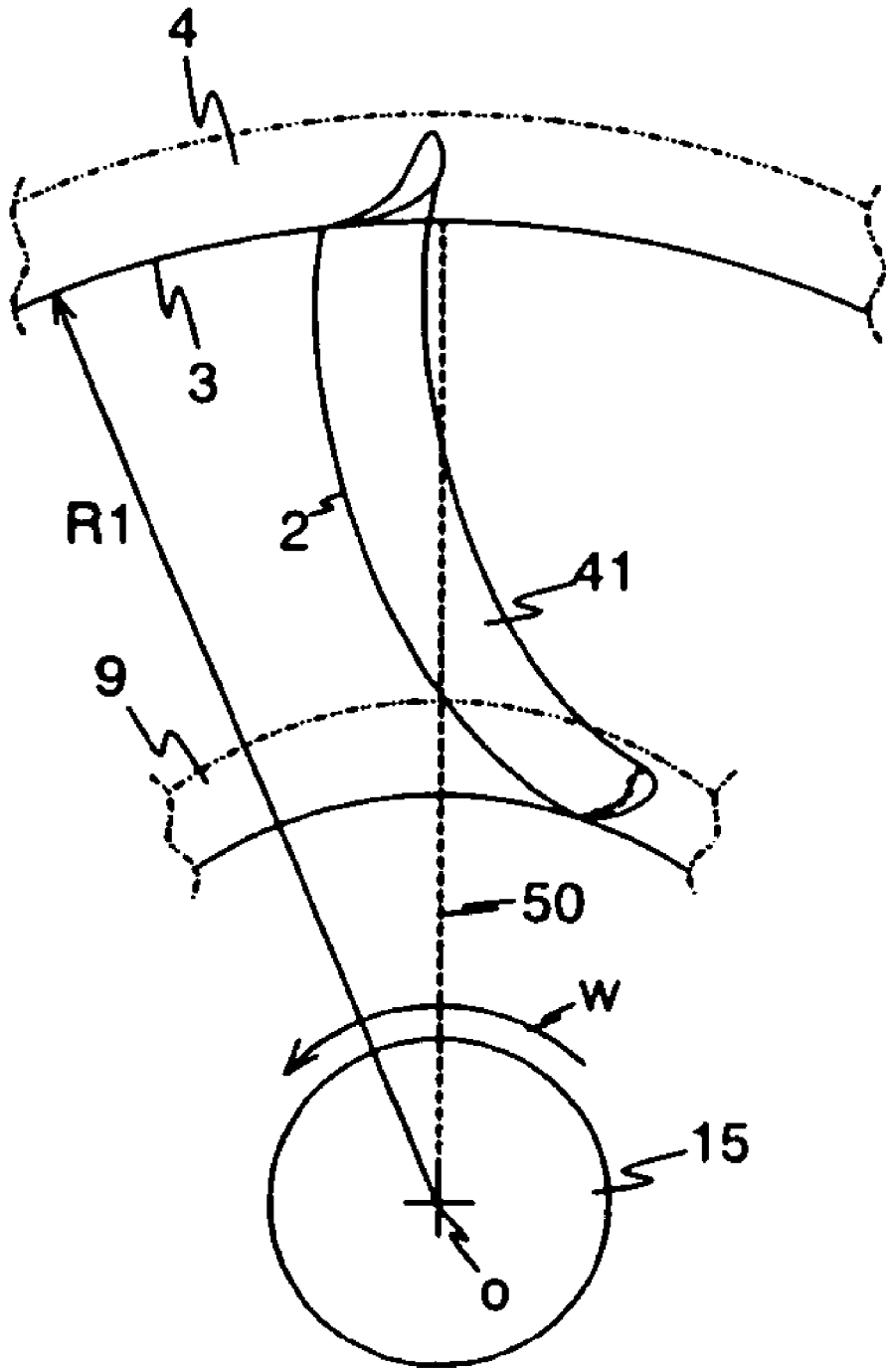
FIG. 18 is a schematic view showing the construction of a stationary blade according to another modification that suppresses a supersonic inflow of the working fluid into the inner peripheral side of the moving blade.

FIG. 18 is a schematic view showing the construction of a stationary blade according to a second modification of the present invention, the stationary blade being used for reducing a supersonic inflow of the working fluid into the moving blade inner peripheral side.

As shown in FIG. 18, the stationary blade 41 is formed into a curved shape so that the trailing edge 2 of the intermediate portion in the blade length direction protrudes in the moving blade rotational direction W. Although the stationary blade 41 is curved in this example, it may also be formed in a bent shape so that the trailing edge 2 of the intermediate portion in the blade length direction protrudes in the moving blade rotational direction W. In either case, the outer peripheral side of the stationary blade 41 extends substantially in the turbine radial direction, and the inner peripheral side of the stationary blade 41 inclines to the moving blade rotational direction W toward the outside in the turbine radial direction, with respect to a reference line 50 extending along the turbine radial direction.

By curving (or bending) the stationary blade 41 as in FIG. 18, a pressure gradient that generates a pressure increase in the radially inward direction occurs on the inner peripheral side, so that an inner peripheral side static pressure between the stationary blade and moving blade in the turbine stage increases. As a result, the stationary blade outlet velocity c6 shown in FIG. 16 can be reduced, which allows the relative velocity w6 with respect to the moving blade to be reduced lower than the sound velocity. Therefore, by combining the stationary blade construction shown in FIG. 18 with that according to the embodiment in FIG. 4, the relative inflow velocity with respect to the moving blade can be reduced lower than the sound velocity in all region along the moving blade length direction, as indicated by the solid line in FIG. 17, even if a further blade elongation is performed. This makes it possible to implement more reliably a flow pattern as designed, thereby resulting in more reduced shock wave loss.

Figure 19:
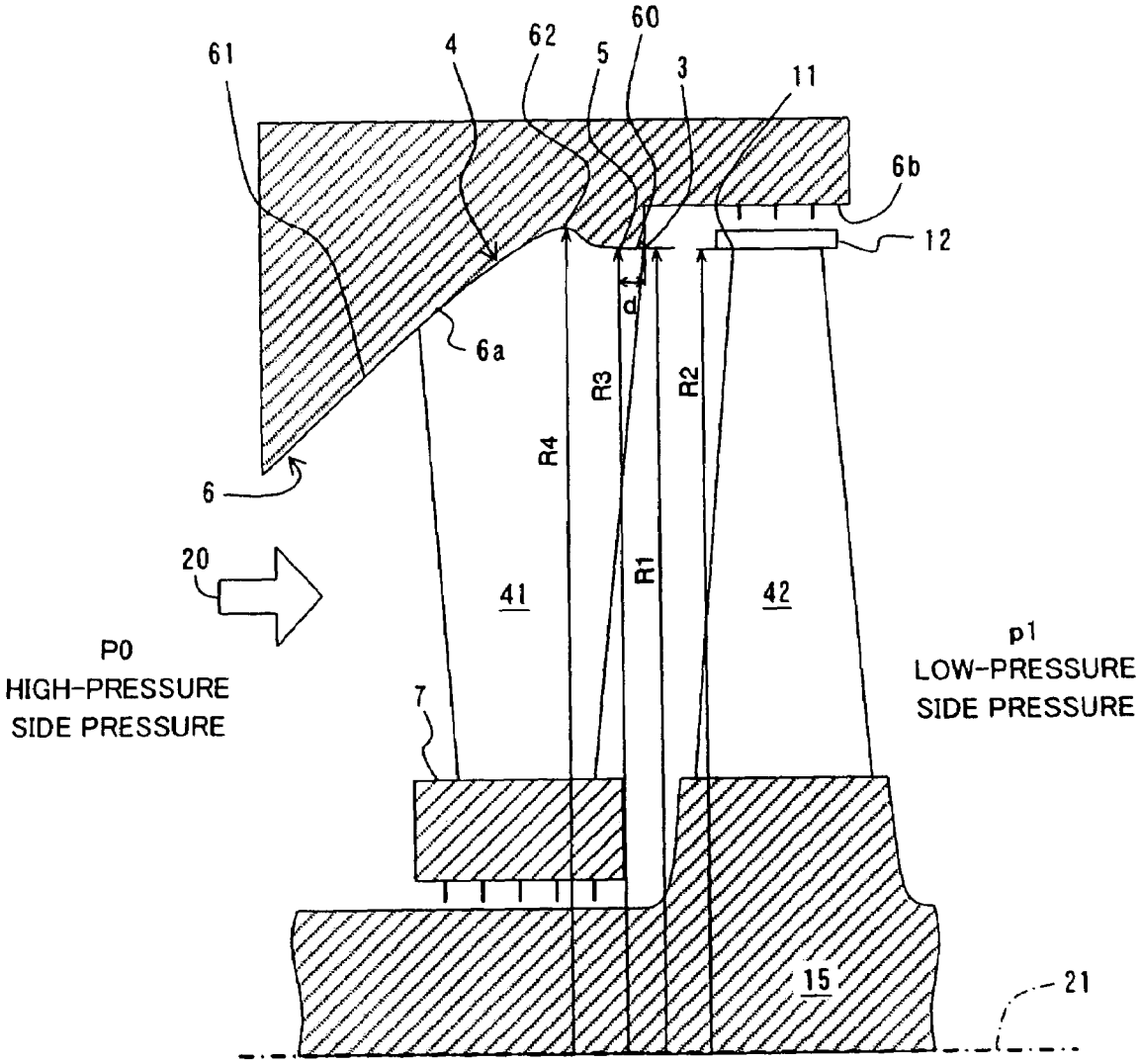
FIG. 19 is a sectional view of the main structure of still another modification of the axial turbine according to the present invention.

FIG. 19 is a sectional view of the main structure of an axial turbine according to a third modification of the present invention.

As shown in FIG. 19, in this example, a stationary blade 41 and a stationary body inner wall surface 6 are formed so as to have, on the upstream side of the flow path constant diameter portion 60, a portion 62 that passes through the outer side in turbine radial direction, of the flow path constant diameter portion 60, and that heads for the inner side in the turbine radial direction toward the downstream side. Here, this portion 62 that heads for the inner peripheral side in the turbine radial direction is reduced as the annular flow path formed by the stationary body wall surface 6*a* on the stationary blade outer peripheral side heads toward the downstream side. Hence, this "portion 62" is referred to as a "flow path reduced diameter portion 62" in the description hereinafter.

Specifically, the flow path reduced diameter portion 62 is located between the flow path enlarged diameter portion 61 and the flow path constant diameter portion 60, and is supplied with a curvature that is convex upwardly in the turbine radial direction. The flow path reduced diameter portion 62 is inflected in the vicinity of a boundary with the flow path constant diameter portion 60, and smoothly connects with the flow path constant diameter portion 60. With respect to the flow path enlarged diameter portion 61, the flow path reduced diameter portion 62 is directly contiguous. The radius R4 of the outermost peripheral portion of the flow path reduced diameter portion 62 satisfies the following relationship.

$$R4>R3 \qquad \text{(Expression 7)}$$

Other constructions are the same as those in FIG. 4.

Figure 20:
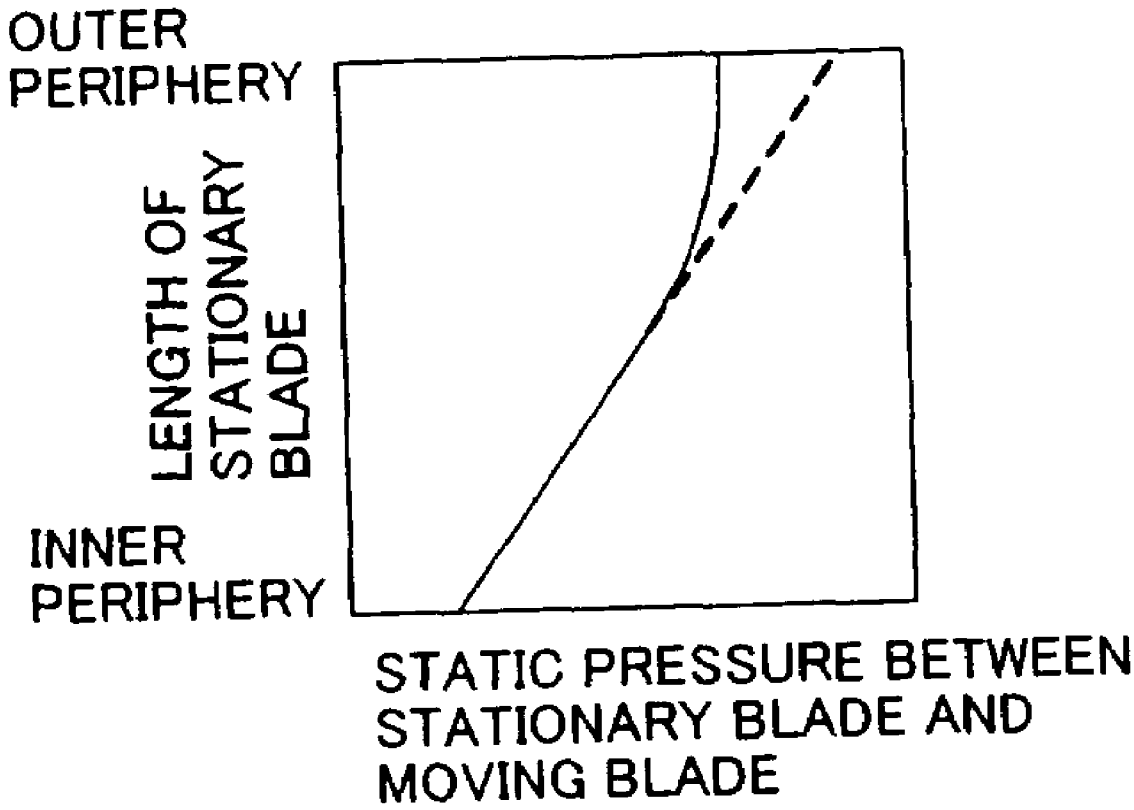
FIG. 20 is a graph showing the change along the blade length direction, of the stationary pressure between the moving blade and stationary blade in the axial turbine according to the still another modification of the present invention.

Because the flow passing through the stationary blade outer peripheral side flows along the stationary blade outer diameter line 4, it is once supplied with a curvature that is convex toward the inner peripheral side in the turbine radial direction when passing through the flow path reduced diameter portion 62. By giving to the flow such a curvature that is convex toward the inner peripheral side, it is possible to release the effect of the flow attempting to expand toward the outer peripheral side in the turbine radial direction under a centrifugal force, between the stationary blade 41 and the moving blade 42 in the turbine stage. As can be seen from FIG. 20, which is a graph showing the change along the blade length direction, of the static pressure between the stationary blade and moving blade, the static pressure between the stationary blade and moving blade of a typical axial turbine increases from the inner peripheral side toward the outer peripheral side in the blade length direction, as indicated by a broken line in FIG. 20. In contrast, in the static pressure distribution between the stationary blade and moving blade in the axial turbine with the construction shown in FIG. 19, an increase in static pressure is suppressed in the region on the outer peripheral side in the turbine radial direction, as indicated by a solid line in FIG. 20. Therefore, by combining the construction in FIG. 19 with that according to the embodiment in FIG. 4, an effect similar to that by the construction in FIG. 4 can be produced, as well as the velocity of a flow exiting from the stationary blade outer peripheral side can be more increased, leading to further reduction in the relative inflow velocity with respect to the moving blade.

In the foregoing descriptions, while the case where the flow path enlarged diameter portion 61 is provided on the stationary blade outer diameter line 4 has been exemplified with reference to the several figures, it suffices only that there is provided the flow path constant diameter portion 60 including at least the stationary blade outlet outer peripheral portion 3, as long as the outward velocity component in the turbine radial direction of a flow having passed through the stationary blade is suppressed. Hence, the flow path enlarged diameter portion 61 is not necessarily required to be provided on the stationary blade outer diameter line 4, but it may be provided between the stationary blade inlet and the moving blade outlet in a preceding stage depending on the circumstances. In this case, a similar effect is produced, as well.

Furthermore, while the case where the stationary blade outer peripheral trailing-edge radius R1 is substantially equalized with the moving blade outer peripheral leading-edge radius R2 (or moving blade effective length outer peripheral radius) has been exemplified with reference to the several figures, this condition is not necessarily required to be satisfied in design, as long as the outward velocity component in the turbine radial direction of a flow having passed through the stationary blade is suppressed. Hence, as long as the relative inflow velocity with respect to the moving blade is reduced lower than the sound velocity without giving to the flow any outward velocity component in the radial direction, it suffices only that the flow path constant diameter portion 60 is provided at least on the downstream side of the stationary blade outer diameter line 4. Also, the relationship between the stationary blade outer peripheral trailing-edge radius R1 and the moving blade outer peripheral leading-edge radius R2 (or moving blade effective length outer peripheral radius) is not necessarily required to be within the range of Expression (5').

What is claimed is:

1. An axial turbine comprising:

a turbine rotor;

a stationary body inner wall located outside of said rotor;

stationary blades provided on the inside of said stationary body inner wall; and moving blades provided on said turbine rotor;

wherein a plurality of turbine stages is formed by said stationary blades and said moving blades, each of turbine stages comprising said stationary blades adjacent to each other along the turbine circumferential direction and said moving blades adjacent to each other along the circumferential direction, said moving blades being opposed to said stationary blades at the downstream of said stationary blades at the downstream of said stationary blades alone a flow direction of a working fluid;

wherein the stationary blade of which the radial height of an outlet thereof is higher than the radial height of an inlet thereof is formed so that an intersection line between a plane containing the central axis of the turbine and the outer peripheral portion of the stationary blade, has a portion that includes the outlet of the stationary blade and that extends in the extending direction of the central axis of the turbine;

wherein a surface of the stationary body inner wall opposed to the outer peripheral side of the moving blade in a stage having the portion that extends in the extending direction of the central axis of the turbine, is located radially outside of the portion that extends in the extending direction of the central axis of the turbine; and wherein, when out of the length of the moving blade, a portion that effectively performs the function of converting energy of the working fluid into a rotational power is defined as a moving blade effective length, the height in the turbine radial direction, of the portion that extends in the extending direction of the central axis of the turbine, is set to be the height in the turbine radial direction, of the effective length of the moving blade in the same stage.

2. An axial turbine comprising:

a turbine rotor;

a stationary body inner wall located outside of said rotor;

stationary body inner wall located outside of said rotor;

stationary blades provided on the inside of said stationary body inner wall; and moving blades provided on said turbine rotor;

wherein a plurality of turbine stages is formed by said stationary blades and said moving blades, each of turbine stages comprising said stationary blades adjacent to each other along the turbine circumferential direction and said moving blades adjacent to each other along the circumferential direction, said moving blades being opposed to said stationary blades at the downstream of said stationary blades along a flow direction of a working fluid;

wherein the stationary blade of which the radial height of an outlet thereof is higher than the radial height of an inlet thereof is formed so that the intersection line between a plane containing the central axis of the turbine and the outer peripheral portion of the stationary blade, has a portion that includes the outlet of the stationary blade and that extends in the extending direction of the central axis of the turbine;

wherein each of the stationary blades in stages located upstream a stage having the portion that extends in the extending direction of the central axis of the turbine, is formed so that the intersection line between a plane containing the central axis of the turbine and the outer peripheral portion of the stationary blade, inclines in radially outward direction toward the downstream side; and wherein the portion that extends in the extending direction of the central axis of the turbine is formed only in the stationary blade in the final stage.

3. An axial turbine comprising:

a turbine rotor;

a stationary body inner wall located outside of said rotor;

stationary blades provided on the inside of said stationary body inner wall; and moving blades provided on said turbine rotor;

wherein a plurality of turbine stages is formed by said stationary blades and said moving blades, each of turbine stages comprising said stationary blades adjacent to each other along the turbine circumferential direction and said moving blades adjacent to each other along the circumferential direction, said moving blades being opposed to said stationary blades at the downstream of said stationary blades at the downstream of said stationary blades along a flow direction of a working fluid;

wherein the stationary blade of which the radial height of an outlet thereof is higher than the radial height of an inlet thereof is formed so that the intersection line between a plane containing the central axis of the turbine and the outer peripheral portion of the stationary blade, has a portion that includes the outlet of the stationary blade and that extends in the extending direction of the central axis of the turbine; and wherein the portion that extends in the extending direction of the central axis of the turbine extends from the axial position of a point on the negative pressure side in the outer peripheral portion of the stationary blade, or from the upstream side of the point, the point minimizing the distance between the stationary blade and a circumferentially adjacent stationary blade.

4. An axial turbine comprising:

a turbine rotor;

a stationary body inner wall located outside of said rotor;

stationary blades provided on the inside of said stationary body inner wall; and moving blades provided on said turbine rotor;

wherein a plurality of turbine stages is formed by said stationary blades and said moving blades, each of turbine stages comprising said stationary blades adjacent to each other along the turbine circumferential direction and said moving blades adjacent to each other along the circumferential direction, said moving blades being opposed to said stationary blades at the downstream of said stationary blades at the downstream of said stationary blades along a flow direction of a working fluid;

wherein the stationary blade of which the radial height of an outlet thereof is higher than the radial height of an inlet thereof is formed so that the intersection line between a plane containing the central axis of the turbine and the outer peripheral portion of the stationary blade, has a portion that includes the outlet of the stationary blade and that extends in the extending direction of the central axis of the turbine; and wherein, in the stage including the portion that extends in the extending direction of the central axis of the turbine, a moving blade front-end peripheral velocity Mach number, obtained by dividing a rotational peripheral velocity of the moving blade front end by the sound velocity in the working fluid flowing into the moving blade front end, exceeds 1.0.

5. The axial turbine according to claim 2, wherein, when out of the length of the moving blade, a portion that effectively performs the function of converting energy of the working fluid into a rotational power is defined as a moving blade effective length, the height in the turbine radial direction, of the portion that extends in the extending direction of the central axis of the turbine, is set to be a height in the turbine radial direction, of the effective length of the moving blade in the same stage.

6. The axial turbine according to claim 5, wherein, when the moving blade has, at the front end thereof, a connection cover for connecting it to another moving blade adjacent thereto along the circumferential direction of the axial turbine, the effective length outer peripheral portion of the moving blade is located between a height position of the inner peripheral surface of the connection cover and a position spaced apart therefrom toward the inner peripheral side along the turbine radial direction by the height of a rounded portion at a joint portion between the connection cover and the moving blade.

7. The axial turbine according to claim 5, wherein, when the front end of the moving blade is a free end, the flow path effective range outer peripheral portion of the moving blade is the front end portion of the moving blade.

8. The axial turbine according to claim 1, wherein, when the moving blade has, at the front end thereof, a connection cover for connecting it with another moving blade adjacent thereto along the circumferential direction of the axial turbine, the portion that extends in the extending direction of the central axis of the turbine has a inclination within a range in which the portion is accommodated between the height position of the inner peripheral surface of the connection cover and the position spaced apart therefrom toward the inner peripheral side along the turbine radial direction by the height of the rounded portion at the joint portion between the connection cover and the moving blade.

9. The axial turbine according to claim 1, wherein the portion that extends in the extending direction of the central axis of the turbine is formed only in the stationary blade in the final stage.

10. The axial turbine according to claim 1, wherein the stationary blade is formed so that the intersection line between a plane containing the central axis of the turbine and the outer peripheral portion of the stationary blade is formed so as to have, on the upstream side of the portion that extends in the extending direction of the central axis of the turbine, a portion that inclines to the outer peripheral side in the turbine radial direction, toward the downstream side.

11. The axial turbine according to claim 10, wherein the stationary blade is formed so that the intersection line between a plane containing the central axis of the turbine and the outer peripheral portion of the stationary blade has a portion that passes through the outside in the turbine radial direction, of the portion that extends in the extending direction of the central axis of the turbine, and that reduces the flow path toward the portion that extends in the extending direction of the central axis of the turbine.

12. The axial turbine according to claim 1, wherein the stationary blade is formed so that the value obtained by dividing a minimum gap between stationary blades adjacent to each other along the circumferential direction of the axial turbine by a distance in the circumferential direction between the stationary blades, becomes smaller on the outer peripheral side of the stationary blade than in an intermediate portion of the stationary blade in the length direction thereof.

13. The axial turbine according to claim 1, wherein the stationary blade is formed so as to incline to a rotational direction of the moving blade toward the peripheral side in the turbine radial direction, and also, so as to be curved or bent in a manner such that the intermediate portion of the stationary blade in the length direction thereof protrudes in the rotational direction of the moving blade.

* * * * *